US006157128A

United States Patent [19]

Namiki et al.

[11] Patent Number: 6,157,128

[45] Date of Patent: Dec. 5, 2000

[54] PLASMA DISPLAY PANEL HAVING COMB SHAPED ELECTRODE WITH TEETH OF SPECIFIC PITCH

[75] Inventors: Fumihiro Namiki; Shigeo Kasahara, both of Kawasaki, Japan

[73] Assignee: Fujitsu Limited, Kawasaki, Japan

[21] Appl. No.: 09/096,569

[22] Filed: Jun. 12, 1998

[30] Foreign Application Priority Data

Jan. 23, 1998 [JP] Japan ..... 10-011135

[51] Int. Cl.[7] ..... H01J 17/00; H01J 61/00

[52] U.S. Cl. ..... 313/581; 313/583; 313/631

[58] Field of Search ..... 313/581, 582, 313/583, 584, 585, 631

[56] References Cited

U.S. PATENT DOCUMENTS

Re. 29,629 5/1978 Ogle ..... 313/582
5,640,068 6/1997 Amemiya .
5,656,893 8/1997 Shino et al. ..... 315/169.4
6,008,580 12/1999 Nakamura et al. ..... 313/568

FOREIGN PATENT DOCUMENTS

0680067 A2 11/1995 European Pat. Off. .
0782167 A2 7/1997 European Pat. Off. .

*Primary Examiner*—Nimeshkumar D. Patel
*Assistant Examiner*—Michael J. Smith
*Attorney, Agent, or Firm*—Staas & Halsey, LLP

[57] ABSTRACT

A plasma display panel includes a pair of substrates and electrodes extending in row direction of display to generate a surface discharge across a pair of the electrodes. In the panel, at least one electrode of the electrode pair for generating the surface discharge is formed in the shape of a comb having a base portion extending in row direction of display and a tooth portion composed of a number of teeth extending from the base portion towards the other electrode. And an arrangement pitch of the teeth is 1/n of an arrangement pitch of cells in row direction of display, in which n is an integer more than or equal to two.

35 Claims, 7 Drawing Sheets

PLASMA DISPLAY PANEL HAVING COMB SHAPED ELECTRODE WITH TEETH OF SPECIFIC PITCH

CROSS-REFERENCE TO RELATED APPLICATION

This application is related to Japanese application No. Hei 10(1998)–11135, filed on Jan. 23, 1998, whose priority is claimed under 35 USC § 119, the disclosure of which is incorporated by reference in its entirety.

BACKGROUND OF THE INVENTION

1. Field of the Invention

The present invention relates to a plasma display panel (PDP) of surface discharge structure.

2. Description of Related Art

PDPs are now attracting much attention as display devices for high definition TV. For higher definition and up-sizing of screens of the PDPs, reduction of power consumption is one of the most significant challenges.

AC-driven PDPs of surface discharge type are now commercially available as color display devices. Here, the surface discharge type means a type in which pairs of first and second main electrodes are arranged in parallel on an inner surface of one of a pair of substrates, and the first and the second main electrodes serve as positive electrodes and as negative electrodes alternately in an AC drive for sustaining a light emission state by use of wall charge. In the surface discharge PDPs, fluorescent layers for color display can be provided on a substrate opposed to the substrate on which the main electrode pairs are placed, and thereby it is possible to prevent the fluorescent layers from being deteriorated by ion impact at electric discharges and increase the life of the devices. A PDP having the fluorescent layers on a rear substrate is called a "reflection type," and the one having the fluorescent layers on a front substrate is called a "projection type." The reflection type, in which a front-side surface of the fluorescent layers emit light, is superior in luminous efficiency.

Conventionally, the main electrodes are formed in the shape of linear belts of constant width extending in a direction of rows (in a direction of display lines) within a display region. The main electrodes are usually spaced in such a manner that the space between adjacent main electrode pairs (an inverse slit width) is sufficiently larger than the space between main electrodes that make a pair (a slit width), for the purpose of preventing discharge coupling between adjacent rows. However, it is also possible to adopt a configuration in which the main electrodes are regularly spaced and each main electrode makes pairs with main electrodes adjacent on either side. Additionally, the main electrode of the reflection type is comprised of an electrically conductive transparent film and a metal film for reducing line resistance.

In the above-described surface discharge PDPs, the slit width which is a surface discharge gap and the width of the main electrodes determine a driving voltage margin. Here, the driving voltage margin means a range of driving voltages which allows stable display to be realized by use of a memory function of a dielectric, and is a difference between a firing voltage Vf and a sustain voltage Vs for sustaining electric discharges. A memory coefficient $\alpha_M$ representative of the magnitude of the memory function is defined by the following formula:

$$\alpha_M=(Vf-Vs)/(Vf/2)$$

A larger memory coefficient $\alpha_M$ brings greater stability and easier driving. Therefore, in designing a PDP, it is desirable to adopt as low a firing voltage Vf as possible for realizing drive at lower voltages and also to increase the memory coefficient by reducing the sustain voltage Vs.

Once dimensional conditions of the main electrodes and the driving voltage are determined, the magnitude of discharge current is uniquely determined. The magnitude of discharge current can be controlled by adjusting the driving voltage within the driving voltage margin. However, since the adjustment range of the driving voltage becomes narrower with a deterioration with age, a sufficient control is practically impossible.

A larger discharge current lead to a higher luminance. At the same time, however, the increase of luminance becomes slow in consequence of ultra violet light absorption by a discharge current. As a result, the luminous efficiency (ratio of luminance to power consumption) declines. In addition, since a larger discharge current results in a larger damage to inner surfaces owing to ion impact, the discharge current must be reduced as low as possible in the viewpoint of the life. To sum up, it is impossible to set the optimum driving voltage range and the optimum discharge current independently of each other in the conventional PDPs. For determining cell structure and conditions of the discharge gas, a well-balanced drive voltage margin and discharge current must be set within a proper range through trial and error.

SUMMARY OF THE INVENTION

An object of the present invention is to provide a plasma display panel which is adapted for setting a discharge current independently of a driving voltage, is easy to assemble and is excellent in productivity.

The present invention provides a plasma display panel comprising a pair of substrates defining an electric discharge space therebetween; and electrodes extending in row direction of display to generate a surface discharge across a pair of the electrodes, wherein at least one electrode of the electrode pair for generating the surface discharge is formed in the shape of a comb having a base portion extending in row direction of display and a tooth portion composed of a number of teeth extending from the base portion towards the other electrode, and an arrangement pitch of the teeth is 1/n of an arrangement pitch of cells in row direction of display, in which n is an integer more than or equal to two.

DESCRIPTION OF THE PREFERRED EMBODIMENTS

Figure 1:
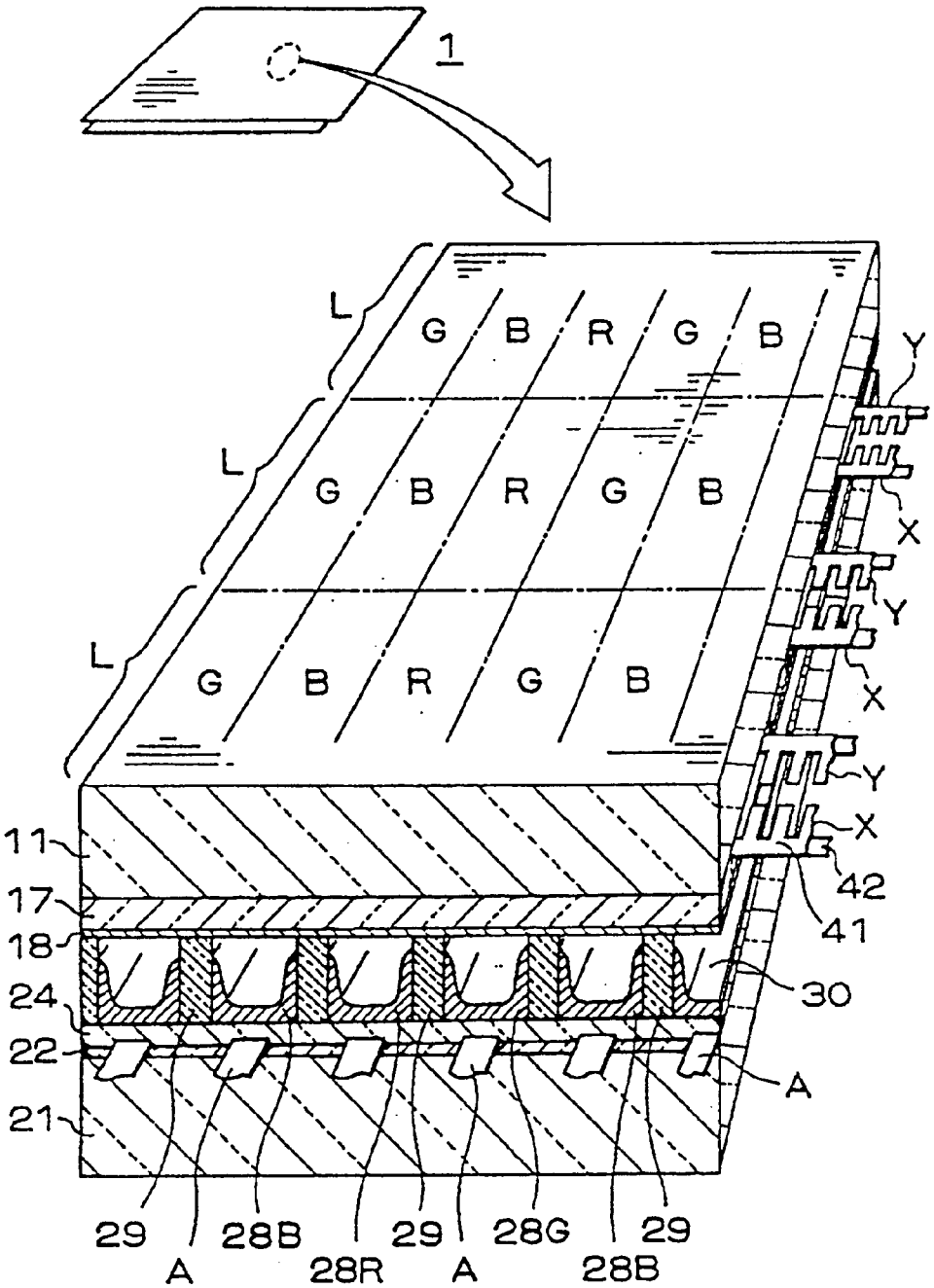
FIG. 1 is a perspective view illustrating the inner construction of a PDP in accordance with the present invention.

In the present invention, electrodes related to a surface discharge which extend in row direction are in the form of comb teeth, and a discharge current is optimizedbydimensions of the comb teeth (tooth portion) As the width of the comb teeth is narrower or the pitch between the comb teeth is larger, effective electrode density decreases and the discharge current declines.

In addition to that, in the present invention, the pitch Ps of the comb teeth and the pitch Pr of cells meet a condition represented by the following formula:

$$Pr=n\cdot Ps$$

wherein n is an integer equal to or more than two.

In the assembling of a PDP, a substrate on which the electrodes are arranged and another substrate are put together in alignment. Even if the substrates are mis-aligned in the direction of rows, the comb teeth are placed in the same positions in all cells provided that the cell pitch Pr is an integer multiple of the comb teeth pitch Ps. If the comb teeth pitch Ps is half or less of the cell pitch Pr, at least one tooth is placed in every cell in the case of a PDP constructed to have ribs partitioning a discharge space for every cell. As a result, the surface discharge can be generated in all the cells. If the comb teeth pitch Ps is the same as the cell pitch Pr, the comb teeth and the ribs may come into complete alignment by mis-alignment in the assembly and as a result, no comb teeth may be responsible for the surface discharge. In other words, if the above-described pitch condition is satisfied, highly accurate alignment in the assembly of the substrates is not necessary. Accordingly, it is possible to keep the same productivity as in the case of a PDP provided with the conventional belt-shaped electrodes.

One or both of the electrodes for the surface discharge which make a pair may be formed into the shape of a comb. In the case where both the electrodes are formed into the comb shape, the dimensions of teeth may be the same, or may be different so that one of the electrodes which is used for addressing has a higher density than the other. In order to increase the electrode density, the width of each tooth may be broadened or the pitch of the teeth may be narrowed.

In the plasma display panel according to the present invention, each electrode of the electrode pair may be formed in the shape of a comb having a base portion extending in the row direction and a tooth portion comprised of a number of teeth extending from the base portion towards the other electrode, and a proportion of the tooth portion per unit area in one electrode of the electrode pair may be larger than that in the other electrode.

In the plasma display panel according to the invention, each electrode of the electrode pair may be formed in the shape of a comb having a base portion extending in the row direction and a tooth portion comprised of a number of teeth extending from the base portion towards the other electrode, and the arrangement pitch of the teeth in one electrode of the electrode pair may be larger than the arrangement pitch of the teeth in the other electrode.

In the plasma display panel according to the invention, each electrode of the electrode pair may be formed in the shape of a comb having a base portion extending in the row direction and a tooth portion comprised of a number of teeth extending from the base portion towards the other electrode, and the width of the teeth in one electrode of the electrode pair may be broader than the width of the teeth in the other electrode.

In the plasma display panel according to the invention, one electrode of the electrode pair may be formed in the shape of a liner belt.

In the plasma display panel according to the present invention, the base portion has a laminar structure of an electrically conductive transparent film and a metal film and the tooth portion is comprised of an electrically conductive transparent film which is made in one piece with the electrically conductive transparent film of the base portion.

In the plasma display panel according to the invention, the cells are defined by the respective electrode pairs in a discharge space partitioned by belt-shaped ribs extending in a direction of columns and crossing the electrode pairs.

Now the present invention is described in further detail by way of example with reference to the accompanying drawings, which should not be construed to limit the scope of the invention.

FIG. 1 is a perspective view illustrating the inner construction of a PDP 1 in accordance with the present invention.

The PDP 1 is a PDP of the surface discharge type which is capable of color display. The PDP 1 has a three electrode matrix structure in which sustain electrodes X and Y as a first and a second main electrode which make a pair intersect an address electrode A as a third electrode in each cell. The sustain electrodes X and Y extend in the row direction (in the horizontal direction) on a screen. One of the sustain electrodes, Y, is also used as a scanning electrode for selecting cells C row by row in addressing. The address electrode A extends in the column direction (in the vertical direction) on the screen and is used as a data electrode for selecting cells C column by column.

The PDP 1 includes a pair of glass substrates which define a discharge space 30 therebetween. The sustain electrodes X and Y are arranged on an inner surface of the front one 11 of the pair of glass substrates in such a manner that one pair of sustain electrodes X and Y is on every row L. The row L is a line of cells in the horizontal direction on a screen. The sustain electrodes X and Y are each comprised of an electrically conductive transparent film 41 and a metal film 42, and are covered with a dielectric layer 17 for AC driving. The metal film 42 serves as an auxiliary conductor for reducing line resistance value. The surface of the dielectric layer 17 is coated with a protection film 18 of MgO. The dielectric layer 17 and the MgO film 18 transmit light. A substrate having thereon constituents of cells, for example, a laminate of the sustain electrodes X and Y, the dielectric layer 17 and the protection film 18, is called a substrate structure. On the rear one 21 of the pair of substrates, provided are a base layer 22, an address electrode A, an insulation layer 24, ribs 29 and fluorescent layers 28R, 28G and 28B of three colors (R, G, B) for color display. Each of the ribs 29 is in the shape of a linear belt in a plan view. By the ribs 29, the discharge space 30 is partitioned in the row direction for each sub-pixel, and the spacing of the discharge space 30 is defined at a fixed value (about 150 $\mu$m). The discharge space 30 is filled with a discharge gas containing a mixture of neon and a small amount of xenon. The fluorescent layers 28R, 28G and 28B are partially excited by ultra-violet rays generated by the surface discharge across the sustain electrodes X and Y, to emit visible color lights.

One pixel for display is composed of three adjacent sub-pixels in the row direction. A structural unit within each sub-pixel is the cell C (see FIG. 2). Since the ribs 29 are formed in a stripe pattern, a part of the discharge space 30 which corresponds to each column is continuous in the column direction, bridging all the rows L. The sub-pixels on the same column emit light of the same color. The space between the electrodes of adjacent rows L (the inverse slit width) is broader than the surface discharge gap (the slit width).

The PDP1 have the above-described structure is produced by a series of steps of disposing the constituents separately on the glass substrates 11 and 21 to prepare the front and rear substrate structures, putting the substrate structures together in an opposing relation and sealing the periphery of a space between the substrate structures, and removing the air from the inside and filling the discharge gas. In the preparation of the front substrate structure, the sustain electrodes X and Y, which is a feature of the present invention, are formed by patterning an ITO thin film to obtain the electrically conductive transparent film 41, then depositing a metal thin film of three-layered structure of chromium-copper-chromium almost all over the surface of the glass substrate 11, and patterning the metal thin film by photolithography.

Figure 2:
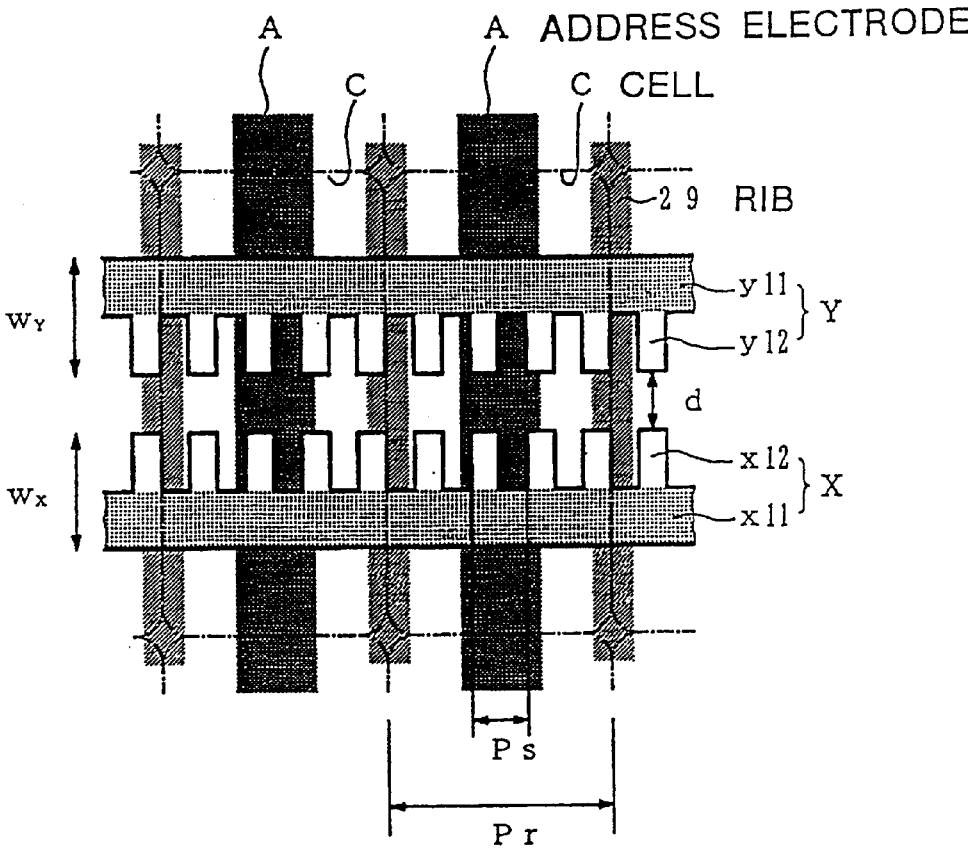
FIG. 2 is a plan view illustrating a basic structure of a pair of electrodes in accordance with the present invention.

FIG. 2 is a plan view illustrating a basic structure of an electrode pair in accordance with the present invention.

The sustain electrode X is formed in the shape of a comb comprised of a base portion X11 in the shape of a linear belt extending in the row direction to cover the whole width of the screen and a large number of teeth X12 arranged at regular intervals which extend from the base portion X11 towards the sustain electrode Y. The sustain electrode Y is also comprised of a base portion Y11 shaped in a linear belt and a large number of teeth Y12 spaced at regular intervals. The sustain electrodes X and Y are symmetrically placed. The width Wx of the sustain electrode X is the same as the width Wy of the sustain electrode Y, for example, about 150 to 250 $\mu$m. The surface discharge gap d is about 50 to 100 $\mu$m. The arrangement pitches Ps of the teeth X12 and Y12 are selected to be 1/n (n is an integer more than or equal to two) of the pitch Pr (about 660 $\mu$m) of the cells. That is to say, the pitches Ps and Pr satisfy the condition of $Pr=n \cdot Ps$. In the example shown in the figure, n is four.

Figure 3A:
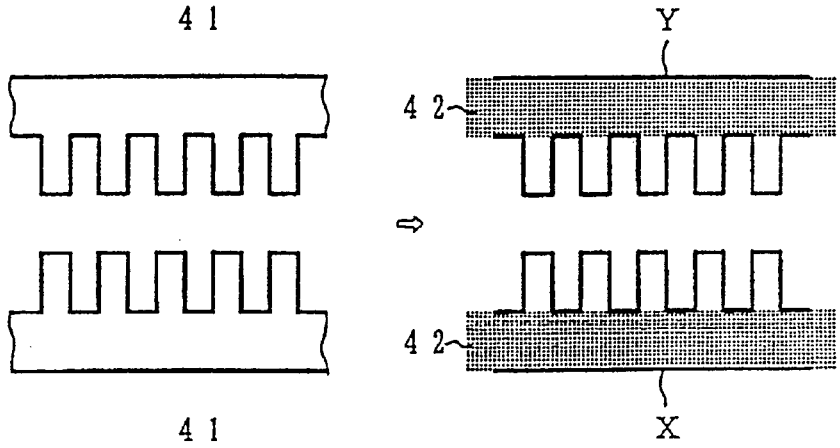
FIGS. 3A and 3B illustrate laminar structures of the pair of electrode.
Figure 3B:
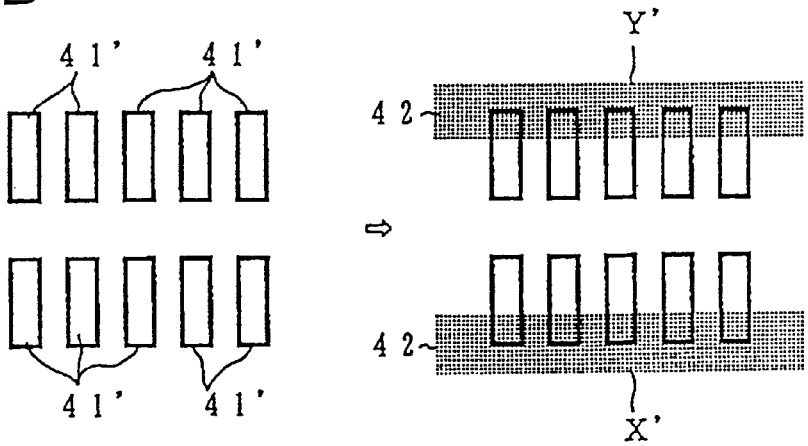

FIGS. 3A and 3B illustrate laminar structures of the electrode pair.

The sustain electrodes X and Y having the above-described shape in a plan view can be formed by forming the electrically conductive transparent film 41 of the comb shape and then put the metal film 42 of the linear belt shape on the base portion of the comb shape, as shown in FIG. 3A. In this case, the width of the metal film 42 need not always be the same as the width of the base portion of the electrically conductive transparent film 41. The width of the metal film 42 can be selected to be the minimum width that can ensure a desired conductivity. Alternatively, as shown in FIG. 3B, the sustain electrodes X and Y can be formed by forming a required number of strips of electrically conductive film 41' in two lines and then putting the metal films 42 of the linear belt shape on each of the lines so that the metal films bridge the strips of the electrically conductive films 41'. However, the formation shown in FIG. 3A in which the metal film 42 is formed on a level plane (the upper surface of the electrically conductive transparent film 41) is more desirable than the formation shown in FIG. 3B in which the metal film needs to be formed to cover steps corresponding to the thickness of the electrically conductive transparent films 41', because the incidence of disconnection is lower in the case of FIG. 3A.

Figure 4:
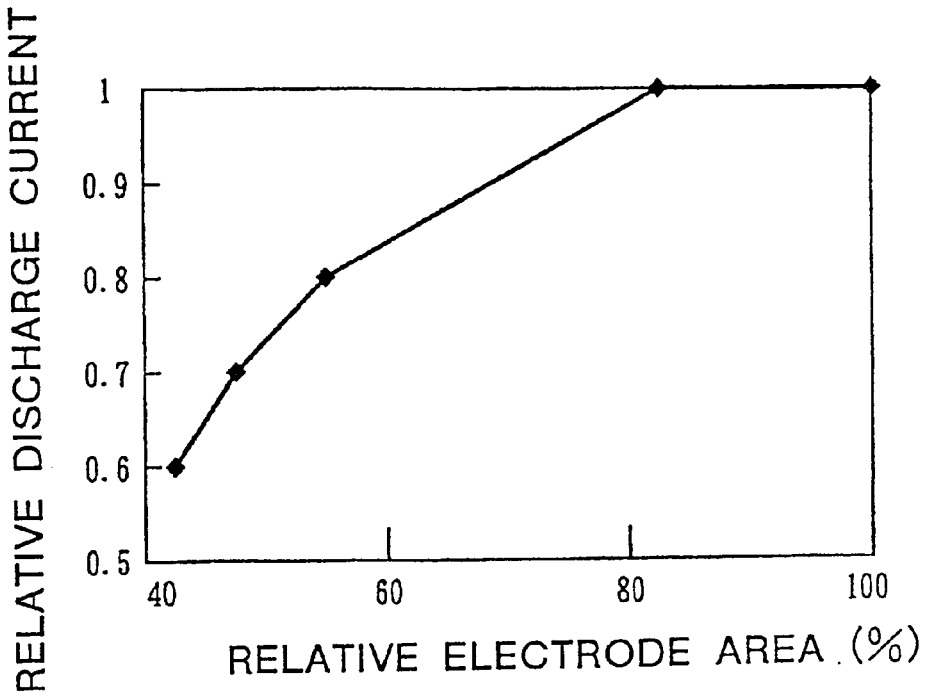
FIG. 4 is a graph showing the relationship between the area of an electrode and discharge current.

FIG. 4 is a graph showing the relationship between the area of an electrode and the discharge current. In FIG. 4, a relative electrode area of 100% means a conventional structure in which the sustain electrodes X and Y are formed in belts having a constant width instead of the comb shape.

With the above-described comb-teeth construction of the electrode pairs for the surface discharge in which the teeth X12 and Y12 are opposed to each other, the discharge current can be reduced without changing the driving voltage. As the proportion of the area of the teeth X12 and Y12 per unit area is reduced by narrowing the widths of the teeth X12 and Y12 or by enlarging the arrangement pitch Ps, the discharge current becomes smaller. In practice, however, since the sustain electrodes X and Y is covered with the dielectric layer 17 and thus a field distribution related to surface discharge does not completely agree with the shape of the electrodes, the effective electrode density hardly changes and the discharge current cannot be sufficiently reduced unless the electrode area is reduced to some extent (to 80% in the example).

Figure 5:
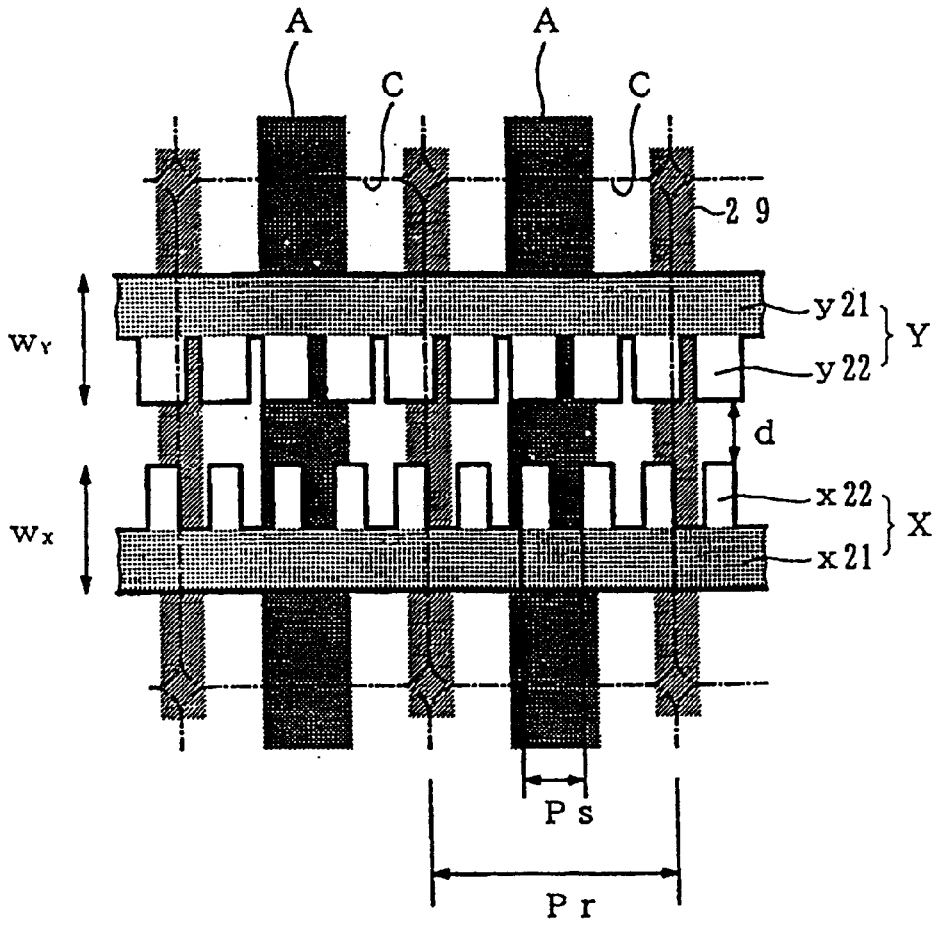
FIG. 5 is a plan view illustrating a first modified structure of electrodes.

FIG. 5 is a plan view illustrating a first modified structure of the electrode pair.

In the foregoing structure of the electrodes, the sustain electrodes X and Y are symmetrically formed. Also in an example shown in FIG. 5, the sustain electrode X is formed in the shape of a comb comprised of a base portion X21 and teeth X22 and the sustain electrode Y is formed in the shape of a comb comprised of a base portion Y21 and teeth Y22. The arrangement pitch Ps of the teeth X22 of the sustain electrode X and the arrangement pitch Ps of the teeth Y22 of the sustain electrode Y are equal and 1/n (n is an integer) of the cell pitch Pr. A feature of the example of FIG. 5 lies in that the width in the row direction of the teeth Y22 of the sustain electrode Y which is also used as a scanning electrode is broader than the width in the row direction of the teeth X22 of the sustain electrode X. With this construction, an opposing area of the sustain electrode Y with respect to the address electrode A is broader than that of the sustain electrode X and as a result, an address discharge is more easily generated. Thus, the discharge current can be reduced with maintaining addressing reliability.

Figure 6:
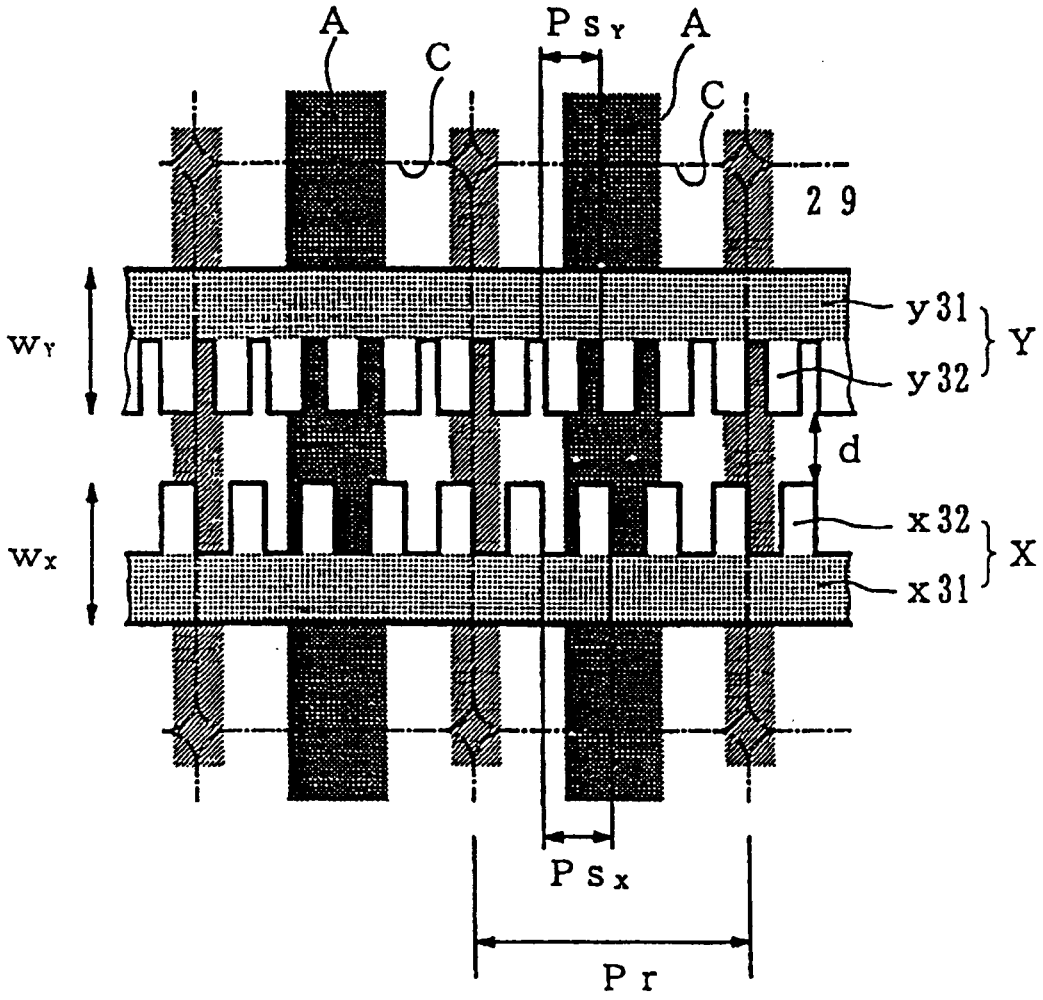
FIG. 6 is a plan view illustrating a second modified structure of electrodes.

FIG. 6 is a plan view illustrating a second modified structure of a pair of electrodes.

Also in the example of FIG. 6, the sustain electrode X is formed in the shape of a comb comprised of a base portion X31 and teeth X32 and the sustain electrode Y is formed in the shape of a comb comprised of a base portion Y31 and teeth Y32. The teeth X32 of the sustain electrode X and the teeth Y32 of the sustain electrode Y are the same in shape and size. However, the arrangement pitch Psy of the teeth Y32 of the sustain electrode Y is smaller than the arrangement pitch Psx of the teeth X32 of the sustain electrode X. With this construction, the opposing area of the sustain electrode Y with respect to the address electrode A is broader and therefore the addressing reliability is improved, as in the example of FIG. 5. Each of the arrangement pitches Psx and Psy is 1/n (n is an integer) of the cell pitch Pr.

Figure 7:
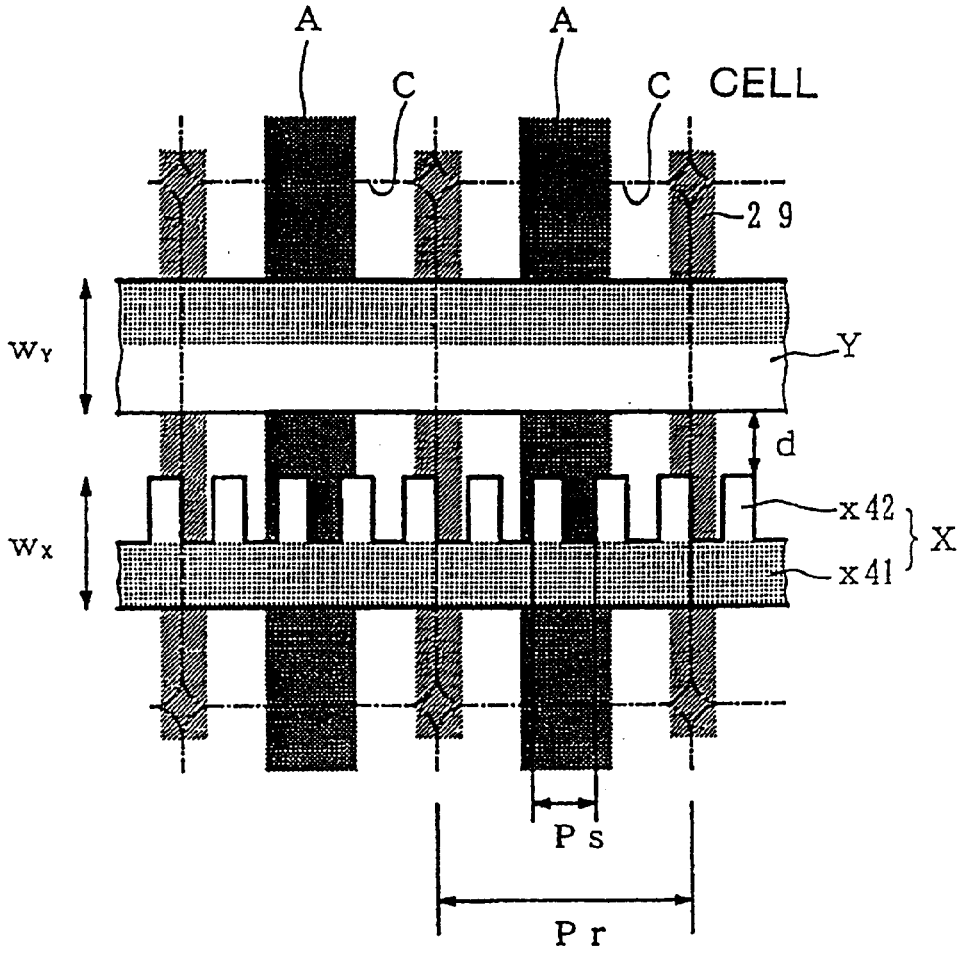
FIG. 7 is a plan view illustrating a third modified structure of electrodes.

FIG. 7 is a plan view illustrating a third modified structure of a pair of electrodes.

The sustain electrode X is formed in the shape of a comb comprised of a base portion X41 and teeth X42. On the other hand, the sustain electrode Y is formed in the shape of a linear belt having a constant width Wy as in the conventional structure. Since the opposing area of sustain electrode Y with respect to the address electrode A is large, the addressing reliability is high.

In the electrode structures of the above-described examples, since one or both of the sustain electrodes X and Y is/are in the comb shape, the discharge current is smaller than in the convention structure. In addition to that, since the arrangement pitches Ps, Psx and Psy are selected to be 1/n (n is an integer) of the cell pitch Pr, the assembly is easy. More particularly, in the assembly of the front substrate structure and the rear substrate structure, the teeth are equally arranged in every cells C even if mis-alignment in the row direction occurs. Further, since the cell pitch Pr is selected to be more than twice as large as the arrangement pitches Ps, Psx and Psy, at least one tooth X12, y12, X22, Y22, X32, Y32 or X42 surely exists between adjacent ribs 29 even if mis-alignment in the row direction occurs. This contributes to reliable surface discharges.

In the above-described examples, the shape of the teeth X12, y12, X22, Y22, X32, Y32 and X42 is rectangular, but the shape thereof is not limited thereto. Alternatively, the teeth may be formed in a tapered trapezoid, for example. Particularly, as concerns the sustain electrode Y that is also used as the scanning electrode a central portion in the direction of extension may be enlarged so that the opposing area thereof to the address electrode A is increased.

Though the present invention has been explained with PDP 1 of the reflection type, the invention is also applicable to PDPs of the projection type. In the case of the projection type, the sustain electrodes X and Y may be made only of metal material. The invention is also applicable not only to PDPs in which the inverse slit width is larger than the slit width (the surface discharge gap d) so that discharge coupling in the row direction is prevented, but also to PDPs in which the sustain electrode X andY are all arranged equidistantly. In such a case, the sustain electrodes X and Y may be formed in the shape of a double-toothed comb having teeth on both sides of a base portion.

According to the present invention, the discharge current can be set independently of the driving voltage. Further, the assembly of the devices is easy and the productivity can be maintained at the same level as that of conventional PDPs.

Further, the addressing reliability can be ensured.

Still further, in the case where the electrode pairs are disposed on the front substrate, the block-off of light by the electrodes can be kept to the minimum, and the disconnection of the metal film, which serves as the auxiliary conductor for reducing the resistance of the electrode, can be prevented.

What is claimed is:

1. A plasma display panel comprising:

a pair of substrates defining an electric discharge space therebetween; and electrodes extending in a row direction of display to generate a surface discharge across a pair of the electrodes, wherein at least one electrode of the electrode pair for generating the surface discharge is formed in the shape of a comb having a base portion extending in the row direction of display and a tooth portion comprising of a number of teeth extending from the base portion towards the other electrode, and an arrangement pitch of the teeth is 1/n of an arrangement pitch of cells in the row direction of display, in which n is an integer more than or equal to two.

2. A plasma display panel according to claim 1, wherein each electrode of the electrode pair is formed in the shape of the comb.

3. A plasma display panel according to claim 2, wherein a proportion of the tooth portion per unit area in one electrode of the electrode pair is larger than that in the other electrode.

4. A plasma display panel according to claim 3, wherein, for the electrode pair, the teeth of the comb shape of one of the electrodes is not interposed with the teeth of the comb shape of the other electrode.

5. A plasma display panel according to claim 2, wherein the arrangement pitches of the teeth of the electrode pair are the same.

6. A plasma display panel according to claim 5, wherein the electrode pairs are symmetrically formed.

7. A plasma display panel according to claim 5, wherein the width of the teeth of one electrode of the electrode pair is broader than the width of the teeth of the other electrode.

8. A plasma display panel according to claim 5, wherein, for the electrode pair, the teeth of the comb shape of one of the electrodes is not interposed with the teeth of the comb shape of the other electrode.

9. A plasma display panel according to claim 2, wherein the arrangement pitch of the teeth of one electrode of the electrode pair is larger than the arrangement pitch of the teeth of the other electrode.

10. A plasma display panel according to claim 9, wherein, for the electrode pair, the teeth of the comb shape of one of the electrodes is not interposed with the teeth of the comb shape of the other electrode.

11. A plasma display panel according to claim 2, wherein the base portion in the comb comprises a laminate of an electrically conductive transparent film and a metal film, and the tooth portion comprises an electrically conductive transparent film which is made in one piece with the electrically conductive transparent film of the base portion.

12. A plasma display panel according to claim 2, wherein the cells are each defined by each electrode pair within a discharge space partitioned by belt-shaped ribs extending in a direction of columns and crossing the electrode pairs.

13. A plasma display panel according to claim 2, wherein, for the electrode pair, the teeth of the comb shape of one of the electrodes is not interposed with the teeth of the comb shape of the other electrode.

14. A plasma display panel according to claim 1, wherein one electrode of the electrode pair is formed in the shape of a linear belt.

15. A plasma display panel according to claim 1, wherein the base portion in the comb comprises a laminate of an electrically conductive transparent film and a metal film, and the tooth portion comprises an electrically conductive transparent film which is made in one piece with the electrically conductive transparent film of the base portion.

16. A plasma display panel according to claim 1, wherein the cells are each defined by each electrode pair within a discharge space partitioned by belt-shaped ribs extending in a direction of columns and crossing the electrode pairs.

17. A plasma display panel according to claim 1, wherein each of said at least one electrode has at least three teeth in a cell.

18. A plasma display panel comprising:

a pair of electrodes extending in a first direction of display to generate a surface discharge across the pair of electrodes, at least one electrode of the pair of electrodes being formed in the shape of a comb having a base portion extending in the first direction and a tooth portion comprising of a number of teeth extending from the base portion towards the other electrode, and an arrangement pitch of the teeth is 1/n of an arrangement pitch of cells in the first direction, n being an integer more than or equal to two.

19. A plasma display panel according to claim 18, wherein each electrode of the pair of electrodes is formed in the shape of the comb.

20. A plasma display panel according to claim 19, wherein a proportion of the tooth portion per unit area in one electrode of the pair of electrodes is larger than that in the other electrode.

21. A plasma display panel according to claim 19, wherein the arrangement pitches of the teeth of the pair of electrodes are the same.

22. A plasma display panel according to claim 21, wherein the electrodes are symmetrically formed.

23. A plasma display panel according to claim 21, wherein the width of the teeth of one electrode of the pair of electrodes is broader than the width of the teeth of the other electrode.

24. A plasma display panel according to claim 19, wherein the arrangement pitch of the teeth of one electrode of the pair of electrodes is larger than the arrangement pitch of the teeth of the other electrode.

25. A plasma display panel according to claim 19, wherein the base portion in the comb comprises a laminate of an electrically conductive transparent film and a metal film, and the tooth portion comprises an electrically conductive transparent film which is made in one piece with the electrically conductive transparent film of the base portion.

26. A plasma display panel according to claim 19, further comprising:

a plurality of cells defined by the pair of electrodes within a discharge space partitioned by ribs crossing the pair of electrodes and parallel to the tooth portion.

27. A plasma display panel according to claim 19, wherein, for the electrode pair, the teeth of the comb shape of one of the electrodes is not interposed with the teeth of the comb shape of the other electrode.

28. A plasma display panel according to claim 18, wherein one electrode of the pair of electrodes is formed in the shape of a linear belt.

29. A plasma display panel according to claim 18, wherein the base portion in the comb comprises a laminate of an electrically conductive transparent film and a metal film, and the tooth portion comprises an electrically conductive transparent film which is made in one piece with the electrically conductive transparent film of the base portion.

30. A plasma display panel according to claim 18, further comprising:

a plurality of cells defined by the electrode pair within a discharge space partitioned by ribs crossing the pair of electrodes and parallel to the tooth portion.

31. A plasma display panel according to claim 18, wherein each of said at least one electrode has at least three teeth in a cell.

32. A plasma display panel comprising:

a pair of electrodes parallel to each other and extending in a first direction of display to generate a surface discharge across the pair of electrodes, at least one electrode of the pair of electrodes being formed in the shape of a comb having a base portion extending in the first direction and a tooth portion comprising of a number of teeth extending from the base portion towards the other electrode; and a plurality of cells defined by the pair of electrodes, wherein an arrangement pitch of the teeth is 1/n of an arrangement pitch of the cells in the first direction, n being an integer more than or equal to two.

33. A plasma display panel according to claim 32, wherein each electrode of the pair of electrodes is formed in the shape of the comb.

34. A plasma display panel according to claim 33, wherein the teeth of the comb shape of one of the electrodes of the pair of electrodes is not interposed with the teeth of the comb shape of the other electrode.

35. A plasma display panel according to claim 32, wherein each of said at least one electrode has at least three teeth in a cell.

* * * * *